US005873345A

United States Patent [19]

Hirooka

[11] Patent Number: 5,873,345

[45] Date of Patent: Feb. 23, 1999

[54] IDLING SPEED CONTROLLER AND IDLING SPEED CONTROL METHOD FOR INTERNAL-COMBUSTION ENGINE

[75] Inventor: Shigemasa Hirooka, Toyota, Japan

[73] Assignee: Toyota Jidosha Kabushiki Kaisha, Toyota, Japan

[21] Appl. No.: 898,786

[22] Filed: Jul. 23, 1997

[30] Foreign Application Priority Data

Jul. 29, 1996 [JP] Japan ..... 8-199469

[51] Int. Cl.[6] ..... F02D 41/08; F02D 41/12

[52] U.S. Cl. ..... 123/339.23; 123/327

[58] Field of Search ..... 123/339.14, 339.15, 123/339.19, 339.23, 339.26, 327, 324

[56] References Cited

U.S. PATENT DOCUMENTS

| | | | |
|---|---|---|---|
| 5,040,506 | 8/1991 | Yamane | 123/327 |
| 5,213,076 | 5/1993 | Umemoto | 123/327 |
| 5,261,368 | 11/1993 | Umemoto | 123/327 |
| 5,630,394 | 5/1997 | Grizzle et al. | 123/339.19 |

FOREIGN PATENT DOCUMENTS

| | | |
|---|---|---|
| 60-19936-A | 2/1985 | Japan . |
| 61-25940-A | 2/1986 | Japan . |
| 61-25941-A | 2/1986 | Japan . |
| 63-29034-A | 2/1988 | Japan . |
| 63-268949-A | 11/1988 | Japan . |

*Primary Examiner*—Willis R. Wolfe
*Assistant Examiner*—Hieu T. Vo
*Attorney, Agent, or Firm*—Oliff & Berridge, PLC

[57] ABSTRACT

The idling speed controller for an internal-combustion engine includes a judging device for determining whether the internal-combustion engine is in an idling state and whether a variation in the revolutional speed of the internal-combustion engine is equal to or greater than a predetermined value, an air amount adjuster that adjusts an air amount supplied to the internal-combustion engine when it is determined that the internal-combustion engine is in the idling state and the variation in the revolutional speed of the internal-combustion engine is equal to or greater than the predetermined value; and a device for prohibiting the adjustment of the air amount by the air amount adjuster after the passing of a predetermined time from a change of a throttle valve form an open state to a substantially closed state.

6 Claims, 6 Drawing Sheets

*FIG. 2A* Throttle valve direct-driving method
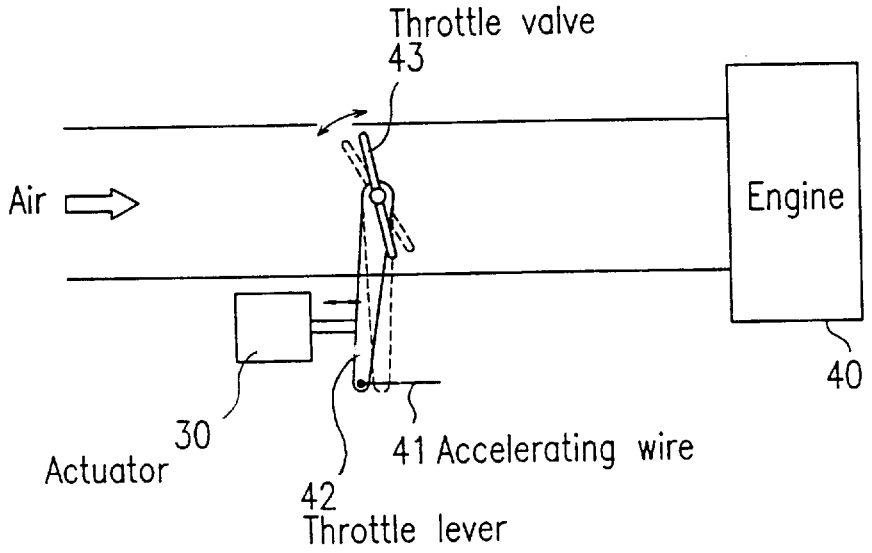
*FIG. 2B* Bypass air method
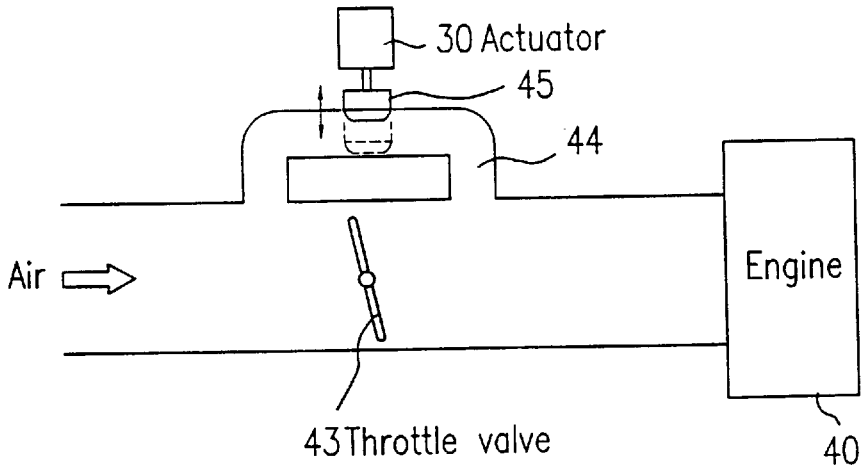

Opening of throttle valve 43
W

WIDL
OFF
ON

XIDL
OFF
T
ON
t1

NE
β rpm

DLNE
γ rpm
Noise
(+)
0
(-)

Control amount
(1)
(2)
t2
Region where engine stall prevention control process is not executed

IDLING SPEED CONTROLLER AND IDLING SPEED CONTROL METHOD FOR INTERNAL-COMBUSTION ENGINE

BACKGROUND OF THE INVENTION

1. Field of the Invention

The present invention relates to an idling speed controller and an idling speed control method for an internal-combustion engine for controlling the revolutional speed of the internal-combustion engine.

2. Description of the Related Art

When the revolutional speed of an internal-combustion engine becomes lower due to a load applied to the internal-combustion engine, the revolution of the internal-combustion engine becomes unstable. This generates vibration which is uncomfortable for the driver is and tends to cause engine stall at the start of driving an idling speed controller is conventionally known where the revolutional speed of en internal-combustion engine is controlled in accordance with the state of the load applied to the internal-combustion engine when the internal-combustion engine is in an idling state. Such an idling speed controller compares the actual revolutional speed of the internal-combustion engine with a predetermined target revolutional speed, determines a control amount so as to match the actual revolutional speed with the target revolutional speed, and drives an actuator so that an air amount corresponding to a control amount can be supplied to the internal-combustion engine. This feedback control of the revolutional speed of the internal-combustion engine is a basis for the idling speed control.

Japanese Laid-Open Patent Publication No. 60-19936 discloses an idling speed control method for an internal-combustion engine. According to this method, when the decrease in the revolutional speed of the internal-combustion engine reaches or exceeds a predetermined value, the air amount supplied to the internal-combustion engine is increased by opening an idling speed control (ISC) valve.

According to the above disclosed idling speed control method, the ISC valve is opened even when the revolutional speed of the internal-combustion engine decreases below the predetermined value. When noise enters an electronic control unit (ECU) due to a disturbance (e.g., external radio wave), the air amount (intake amount) supplied to the internal-combustion engine may unnecessarily increase. This results in an unnecessary increase in the revolutional speed of the internal-combustion engine.

An objective of the present invention is to provide an idling speed controller and an idling speed control method for an internal-combustion engine, where the revolutional speed of the internal-combustion engine is not increased when due to noise, a decrease in the revolutional speed of the internal-combustion engine reaches or exceeds a predetermined values.

SUMMARY OF THE INVENTION

The idling speed controller for an internal-combustion engine of this invention includes: means for judging whether or not the internal-combustion engine is in an idling state; means for judging whether or not a variation in the revolutional speed of the internal-combustion combustion engine is equal to or more than a predetermined value; air amount adjustment means for adjusting an air amount supplied to the internal-combustion engine when it is judged that the internal-combustion engine is in the idling state and the variation in the revolutional speed of the internal-combustion engine is equal to or more than the predetermined value; and means for prohibiting the adjustment of the air amount by the air amount adjustment means after the passing of a predetermined time from a change of a throttle valve from an open state to a substantially closed state.

In one embodiment of the invention, the air amount adjustment means includes an actuator for driving a throttle lever, and an opening of the throttle valve is adjusted in association with the throttle lever.

In another embodiment of the invention, the air amount adjustment means includes an actuator for driving an idling speed control valve disposed in a bypass bypassing the throttle valve and connecting an upstream of the throttle valve with a downstream of the throttle valve.

According to another aspect of the invention, an idling speed control method for an internal-combustion engine is provided. The method includes the steps of: a) judging whether or not the Internal-combustion engine is in an idling state; b) judging whether or not a variation in the revolutional speed of the internal-combustion engine is equal to or more than a predetermined value; c) adjusting an air amount supplied to the internal-combustion engine when it is judged that the internal-combustion engine is in the idling state and the variation in the revolutional speed of the internal-combustion engine is equal to or more than the predetermined value; and d) prohibiting the adjustment of the air amount in step c) after the passing of a predetermined time from a change of a throttle valve from an open state to a substantially closed state.

In one embodiment of the invention, step d) includes the steps of: detecting a change in a signal XIDL; and prohibiting the adjustment of the air amount in step c) after the passing of a predetermined time t from the change in the signal XIDL, and the signal XIDL changes when a predetermined time T has passed from a change in a throttle full close signal WIDL and an opening of the throttle valve is smaller than a predetermined multiple of an opening of the throttle valve at the moment of the change of the throttle full close signal WIDL.

In another embodiment of the invention, the adjustment of the air amount in step c) is performed by an actuator, and the prohibition of the adjustment of the air amount in step d) is achieved by setting a control amount for driving the actuator at zero.

Thus, in the idling speed controller for the internal-combustion engine according to the present invention, the adjustment of the air amount by the air amount adjustment means is prohibited after a predetermined time has passed since the throttle valve switches from the open state to a substantially closed state. With this control, the air amount is not adjusted when the variation in the revolutional speed of the internal-combustion engine reaches or exceeds a predetermined amount due to noise after a predetermined time passes This means that the control of increasing the intake amount in response to the decrease in the revolutional speed of the internal-combustion engine is not executed when the idling state of the internal-combustion engine continues for a predetermined period, i.e., when the car stops or runs in a creep state, for example. As a result, the revolutional speed of the internal-combustion engine is prevented from unnecessarily increasing due to noise entering the ECU.

Thus, the invention described herein makes possible the advantages of (1) providing an idling speed controller for en internal-combustion engine, where the revolutional speed of the internal-combustion engine is not increased when due to noise, a decrease in the revolutional speed of the internal-combustion engine reaches or exceeds a predetermined value, and (2) providing an idling speed control method employed for the idling speed controller.

These and other advantages of the present invention will become apparent to those skilled in the art upon reading and understanding the following detailed description with reference to the accompanying figures.

BRIEF DESCRIPTION OF THE DRAWINGS

FIGS. 2A and 2B are views illustrating methods for adjusting the air amount supplied to an engine by use of an actuator.

FIG. 6A shows an opening of a throttle valve, FIG. 6B is a waveform of a throttle full close signal WIDL, FIG. 6C is a waveform of a signal XIDL, FIG. 6D is a waveform of the revolutional speed NE of an engine, FIG. 6E is a waveform of a variation DLNE in the revolutional speed NE of the engine, and FIG. 6F is a waveform of a control amount.

DESCRIPTION OF THE PREFERRED EMBODIMENTS

The present invention will be described by way of example with reference to the accompanying drawings.

Figure 1:
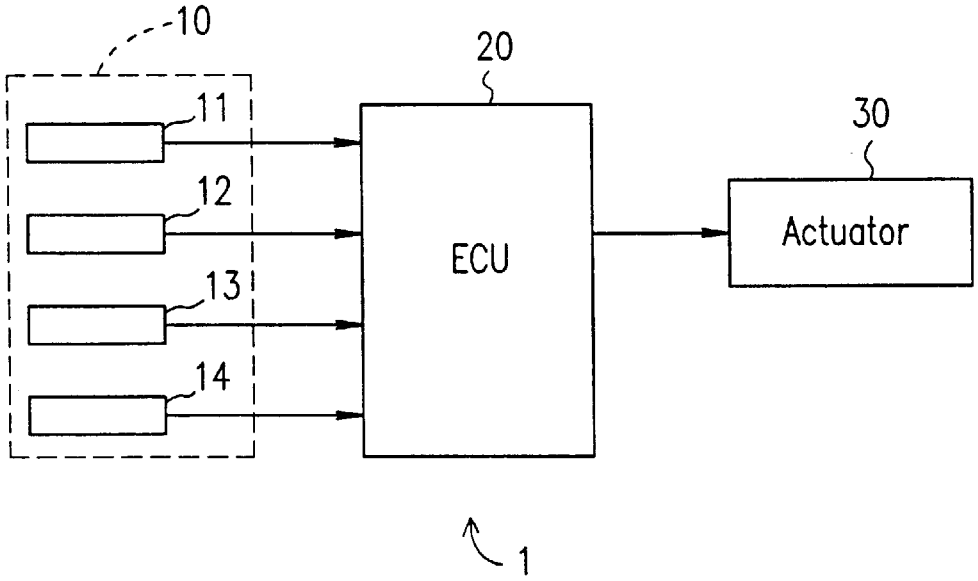
FIG. 1 is a block diagram of an idling speed controller for an internal-combustion engine according to the present invention.

FIG. 1 shows a configuration of an idling speed controller 1 for an internal-combustion engine according to the present invention. The idling speed controller 1 includes a sensor section 10, an electronic control unit (ECU) 20, and an actuator 30.

The sensor section 10 includes various sensors 11 to 14. The functions of these sensors will be described later.

The ECU 20 determines a target revolutional speed of an engine 40 (see FIGS. 2A and 2B) in accordance with signals supplied from the sensor section 10, calculates a control amount so as to match the actual revolutional speed of the engine 40 with the target revolutional speed, and outputs a driving signal indicating the control amount to the actuator 30.

The actuator 30 adjusts the air amount supplied to the engine 40 in accordance with the driving signal output from the ECU 20. As the air amount supplied to the engine 40 increases, the revolutional speed of the engine 40 increases. In reverse, as the air amount supplied to the engine 40 decreases, the revolutional speed of the engine 40 decreases. Thus, by adjusting the air amount supplied to the engine 40 by use of the actuator 30, the feedback control of the engine 40 is realized.

FIGS. 2A and 2B illustrate two methods for adjusting the air amount supplied to the engine 40 by use of the actuator 30. The idling speed controller 1 according to the present invention is applicable to either of these methods. In both methods, the actuator 30 serves as a mechanism of adjusting the air amount supplied to the engine 40 in the idling state.

FIG. 2A illustrates a throttle valve direct-driving method, where a throttle lever 42 connected with an accelerating wire 41 is driven by the actuator 30, so that the opening of a throttle valve 43 associated with the throttle lever 42 can be adjusted. The throttle lever 42 can be directly driven by the actuator 30 without the accelerating wire 41. In this way, the air amount supplied to the engine 40 is adjusted.

FIG. 2B illustrates a bypass air method, where a bypass 44 is formed to connect the upstream of the throttle valve 43 with the downstream thereof while bypassing the throttle valve 43. The bypass 44 is provided with an idling speed control (ISC) valve 45 which adjusts the air amount flowing through the bypass 44. The opening of the ISC valve 45 is adjusted by the actuator 30. In this way, the air amount supplied to the engine 40 is adjusted.

Figure 3:
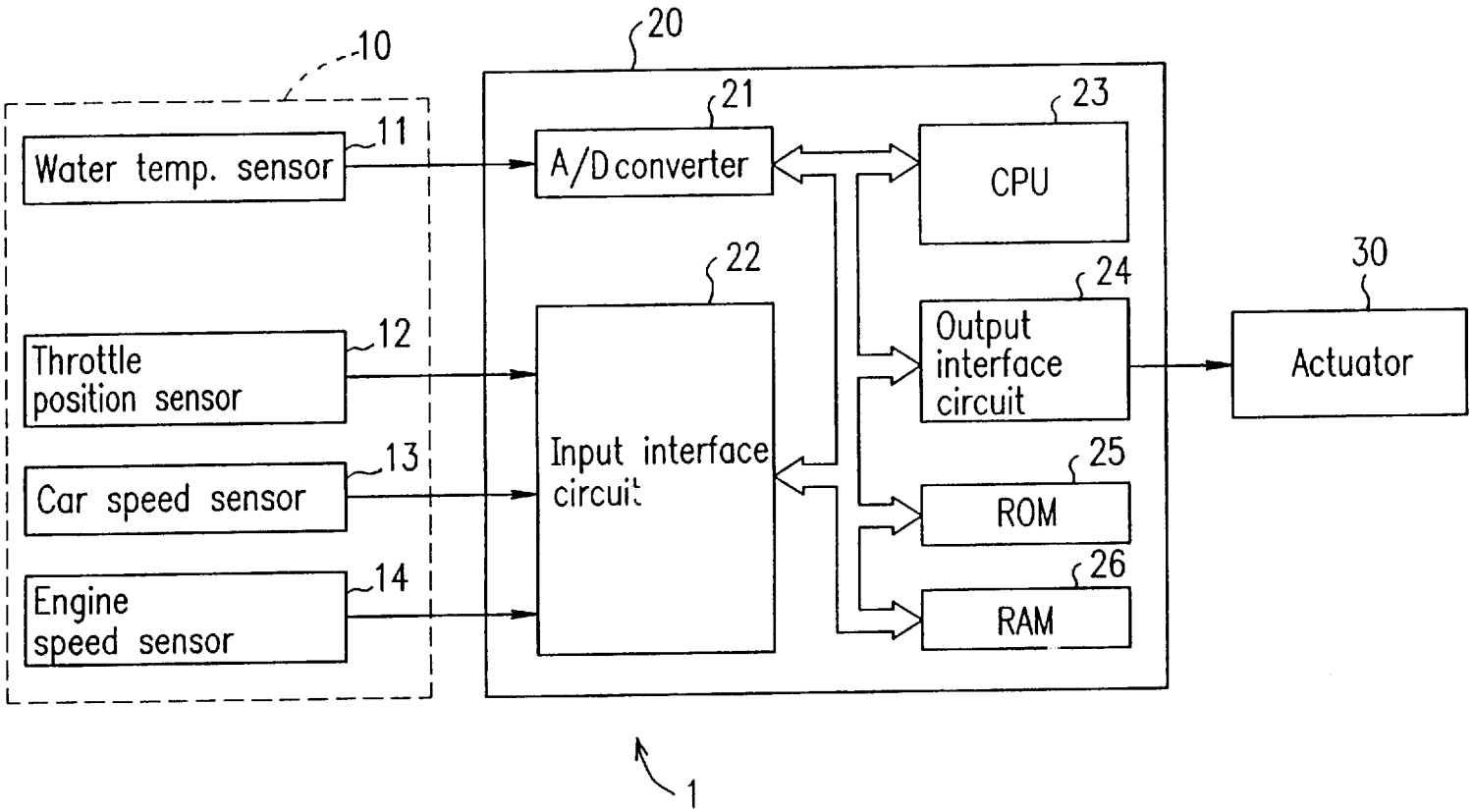
FIG. 3 is a block diagram of an electronic control unit (ECU) of the idling speed controller according to the present invention.

FIG. 3 shows a configuration of the ECU 20 of the idling speed controller 1. The ECU 20 includes an analog/digital (A/D) converter 21, an input interface circuit 22, a CPU 23, an output interface circuit 24, a read-only memory (ROM) 25, and a random access memory (RAM) 26.

The A/D converter 21 is connected with a water temperature sensor 11. The water temperature sensor 11 detects the temperature of engine cooling water and outputs a detection signal indicating the temperature of the engine cooling water to the A/D converter 21. The A/D converter 21 converts the analog detection signal output from the water temperature sensor 11 into a digital value.

The input interface circuit 22 Is connected with a throttle position sensor 12, a car speed sensor 13, and an engine speed sensor 14.

The throttle position sensor 12 detects when the opening of the throttle valve 43 is equal to or less than a predetermined threshold, for example, 1.2° and outputs a throttle full close signal WIDL Indicating the detection result to the Input interface circuit 22. For example, the throttle full close signal WIDL is a signal which is In a high level (ON state) when the opening of the throttle valve 43 is equal to or less then the is predetermined threshold end otherwise in a low level (OFF state).

The car speed sensor 13 detects the speed of the car and outputs a detection signal indicating the car speed to the Input interface circuit 22.

The engine speed sensor 14 detects the actual revolutional speed of the engine 40 and outputs a detection signal indicating the revolutional speed to the input interface circuit 22.

The outputs of the throttle position sensor 12, the car speed sensor 13, and the engine speed sensor 14 are sent to the CPU 23 via the input interface circuit 22.

The CPU 23 executes various control programs in accordance with the outputs from the sensors, to generate a driving signal for driving the actuator 30. The driving signal is output to the actuator 30 via the output interface circuit 24.

The ROM 25 stores the control programs to be executed by the CPU 23. The RAM 26 stores data and the like required for the execution of the control programs.

Figure 4:
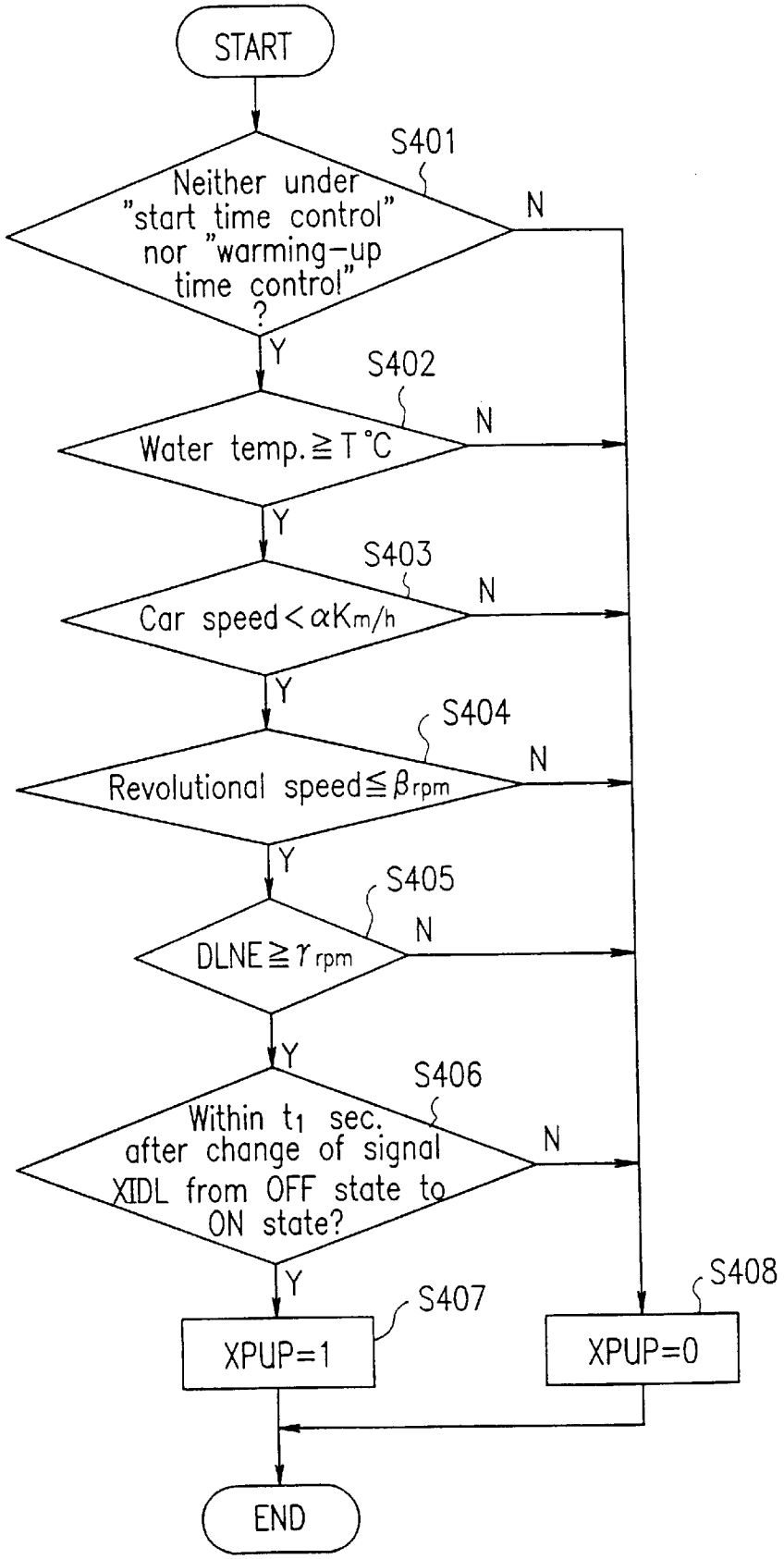
FIG. 4 is a flowchart showing a procedure of an engine stall prevention control process.

FIG. 4 shows a procedure of an engine stall prevention control process. This procedure is stored in the ROM 25 in the form of program codes, for example. The engine stall prevention control process is executed by the CPU 23 when the CPU 23 judges that the engine 40 is in the idling state.

Herein, when "the engine 40 is in the idling state", it is defined that the throttle full close signal WIDL is in the ON state and the car speed is equal to or less than a predetermined value (e.g., 2 km/h). Whether or not the engine 40 is in the idling state is judged by the CPU 23 based on the outputs of the throttle position sensor 12 and the car speed sensor 13.

Hereinbelow, the procedure of the engine stall prevention control process will be described step by step with reference to the flowchart of FIG. 4.

At step S401, whether or not the engine is under "start time control" and whether or not it is under "warming-up time control" are judged. If the engine is judged neither under the "start time control" nor under the "warming-up time control", the process proceeds to step S402. Otherwise, the process proceeds to step S408.

Whether or not the engine is under the "start time control" is represented by a start time control flag which is stored in the RAM 26, for example. The value of the start time control flag is "1" when the engine is under the "start time control" and "0" when it is not under the "start time control". The CPU 23 judges whether or not the engine is under the "start time control" by examining the start time control flag.

Whether or not the engine is under the "warming-up time control" is represented by a warming-up time control flag which Is stored in the RAM 26, for example. The value of the warming-up time control flag is "1" when the engine is under the "warming-up time control" and "0" when it is not under the "warming-up time control". The CPU 23 judges whether or not the engine is under the "warming-up time control" by examining the warming-up time control flag.

The "start time control" is one type of the idling speed control. According to the "start time control", the air amount supplied to the engine is adjusted in accordance with the cooling water temperature at the start of the actuation of the engine. In general, the opening of the ISC valve is controlled to be larger as the cooling water temperature is lower.

The "warming-up time control" is another type of the idling speed control. According to the "warming-up time control", after the completion of the start time control, the ISC valve is gradually closed as the cooling water temperature rises. The "warming-up time control" is terminated when the cooling water temperature reaches a predetermined value (e.g., 70° C.)

At step S402, whether or not the cooling water temperature is equal to or more than a predetermined value (T °C.) is judged. If the cooling water temperature is judged to be equal to or more than the predetermined value (T °C.), the process proceeds to step S403. Otherwise, the process proceeds to step S408. The cooling water temperature is obtained from the output of the water temperature sensor 11. The predetermined value (T °C.) is set in the range of 60° C. to 70° C., for example.

At step 6403, whether or not the car speed is lower than a predetermined value (α km/h) is judged. If the car speed is judged to be lower than the predetermined value (α km/n), the process proceeds to step S404. Otherwise, the process proceeds to step S408. The car speed is obtained from the output of the car speed sensor 13. The predetermined value (α km/h) is set at about 10 km/h, for example.

At step S404, whether or not the revolutional speed of the engine 40 is equal to or less than a predetermined value (β rpm) is judged. If the revolutional speed of the engine 40 is judged to be equal to or less than the predetermined value (β rpm), the process proceeds to step S405. Otherwise, the process proceeds to step S408. The revolutional speed of the engine 40 is obtained from the output of the engine speed sensor 14. The predetermined value (β rpm) is set in the range of 1000 rpm to 1200 rpm, for example.

At step S405, whether or not the variation DLNE in the revolutional speed of the engine 40 is equal to or more than a predetermined value (γ rpm) is judged. If the variation DLNE in the revolutional speed of the engine 40 is equal to or more than the predetermined value (γ rpm), the process proceeds to step S406. Otherwise, the process proceeds to step S408. The predetermined value (γ rpm) is set in the range of 20 rpm to 30 rpm, for example.

The variation DLNE in the revolutional speed of the engine 40 is defined as a variation of NESM64 at an interval of 32 ms. More specifically, the variation DLNE in the revolutional speed of the engine 40 is represented by expression (1) below:

$$DLNE=(NESM_{1-1}-NESM_1)/2 \quad \ldots (1)$$

wherein $NESM_{1-1}$ and $NESM_1$ denote average values of the revolutional speed NE of the engine 40 over the time constant of 64 ms. Alternatively, $NESM_{1-1}$ and $NESM_1$ may denote smoothing values of the revolutional speed NE of the engine 40. $NESM_1$ is represented by expression (2) below:

$$NESM_1=(NE-NESM_{1-1})/2+NESM_{1-1} \quad \ldots (2)$$

At step S406, whether or not the time which has passed since a signal XIDL changed from the OFF state to the ON state is within $t_1$ seconds is judged. If the time is equal to or less than $t_1$ seconds, the process proceeds to step S407. Otherwise, the process proceeds to step S408.

The signal XIDL is either in the OFF state or in the ON state: The signal XIDL changes from the OFF state to the ON state when a predetermined time T has passed since the throttle full close signal WIDL changed from the OFF state to the ON state and the opening of the throttle valve 43 is smaller than a half of the opening of the throttle valve 43 at the moment of the change of the throttle full close signal WIDL from the OFF state to the ON state.

Thus, the change of the signal XIDL from the OFF state to the ON state indicates that the throttle valve 43 has switched from the open state to a substantially closed state.

The time passing after the change of the signal XIDL from the OFF state to the ON state is counted by an internal variable counter held in a program, for example.

At step S407, an engine stall prevention control execution flag XPUP is set at 1. Thus, only when all the conditions for execution shown in steps S401 to S406 are satisfied, the engine stall prevention control execution flag XPUP is set at 1.

At step S408, the engine stall prevention control execution flag XPUP is set at 0. Thus, when at least one of the conditions for execution shown in steps S401 to S406 is not satisfied, the engine stall prevention control execution flag XPUP is set at 0.

Figure 5:
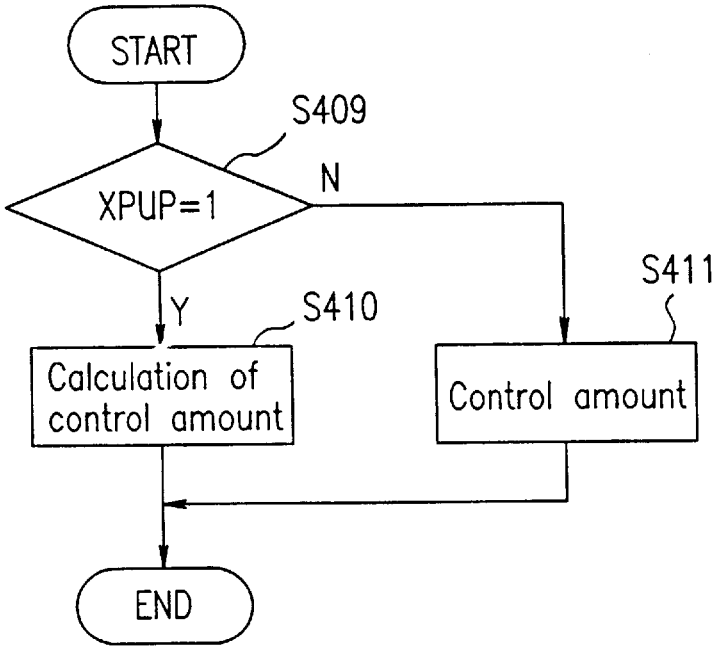
FIG. 5 is a flowchart showing a procedure of a control amount calculation process.

FIG. 5 shows a procedure of a control amount calculation process which is stored in the ROM 25 in the form of program codes, for example. The control amount calculation process is executed by the CPU 23 every predetermined time.

Hereinbelow, the procedure of the control amount calculation process will be described step by step with reference to FIG. 5.

At step S409, whether or not the engine stall prevention control execution flag XPUP is 1 is judged. If the engine stall prevention control execution flag XPUP is 1, the control amount is calculated at step S410. If it is 0, the control amount is set at 0 at step S411.

The control amount calculated at step S410 may be a function of time. For example, the control amount may have an initial value $C_0$ at time $T_0$ and from time $T_0$ decrease by $\delta C$ with the passing of every unit of time until the control amount reaches 0. The CPU 23 outputs the driving signal indicating the control amount to the actuator 30.

As described above, the control amount is set at 0 when at least one of the conditions for execution shown in steps S401 to S406 are not satisfied. Also, even if all the above conditions for execution are satisfied, the control amount is set at 0 after $t_1$ seconds have passed since the signal XIDL changed from the OFF state to the ON state. When the control amount is set at 0, the actuator 30 is not driven. This means that the adjustment of the air amount by the actuator 30 is prohibited after $t_1$ seconds have passed since the signal XIDL changed from the OFF state to the ON state.

In this example, the adjustment of the air amount by the actuator 30 was prohibited indirectly by setting the control amount at 0 after the passing of $t_1$ seconds from the change of the signal XIDL from the OFF state to the ON state. The present invention is not restricted to this control method, but any control methods, direct or indirect, are included in the scope of the present invention as long as the adjustment of the air amount by the actuator 30 can be prohibited after the passing of $t_1$ seconds from the change of the signal XIDL from the OFF state to the ON state.

FIGS. 6A to 6F are waveforms for describing an exemplary operation of the idling speed controller according to the present invention.

Figures 6A, 6B, 6C, 6D, 6E, 6F:
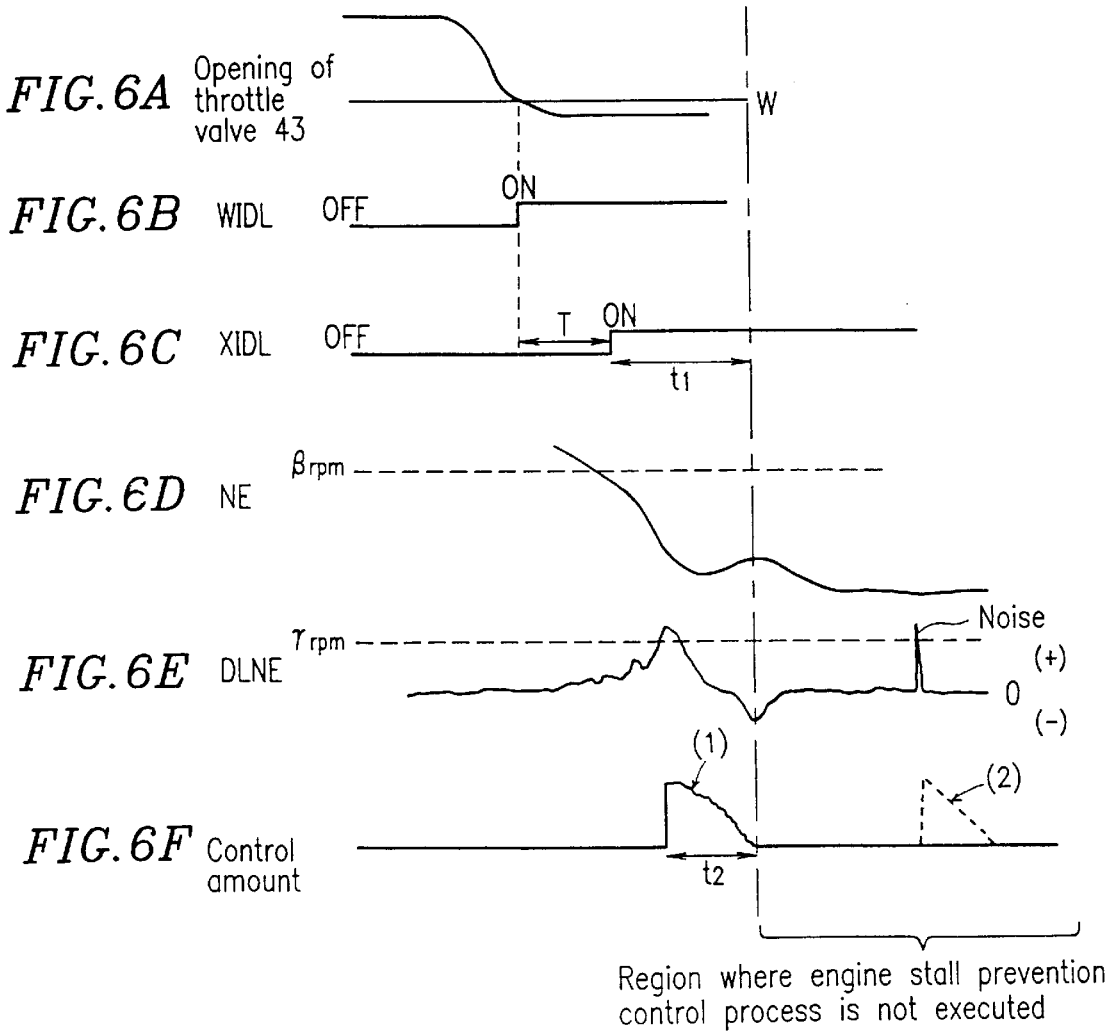
FIGS. 6A to 6F are waveforms for describing an operation of the idling speed controller according to the present invention, where

FIG. 6A shows an opening of the throttle valve 43. When the opening of the throttle valve 43 becomes smaller than a predetermined value W, the throttle full close signal WIDL changes from the OFF state to the ON state (see FIG. 6B). The predetermined value W is 1.2°, for example. FIG. 6B is a waveform of the throttle full close signal WIDL.

FIG. 6C is a waveform of the signal XIDL, which changes from the OFF state to the ON state when T seconds have passed since the throttle full close signal WIDL changed from the OFF state to the ON state and the opening of the throttle valve 43 is smaller than a predetermined threshold (e.g., ½ W).

FIG. 6D is a waveform of the revolutional speed NE of the engine 40. FIG. 6E is a waveform of the variation DLNE of the revolutional speed NE of the engine 40.

FIG. 6F is a waveform of the control amount, where the portion indicated by (1) represents the control amount obtained by the calculation at step S410. Time $t_2$ during which the control amount varies is designed to be shorter than time $t_1$.

The control amount indicated by (1) in FIG. 6F was obtained by the calculation at step S410 because the conditions for executing the engine stall prevention control, that is, the conditions that the revolutional speed NE of the engine 40 is equal to or less than β rpm and that the variation DLNE in the revolutional speed NE of the engine 40 is equal to or more than γ rpm (steps S404 and S405 in FIG. 4), as well as the condition that the time which has passed since the signal XIDL changed from the OFF state to the ON state is within $t_1$ seconds (step S406 in FIG. 4), were satisfied. The other conditions for executing the engine stall prevention control are presumed to have been satisfied though not shown in FIGS. 6A to 6F.

The control amount is set at 0 after $t_1$ seconds have passed since the signal XIDL changed from the OFF state to the ON state, i.e., since the throttle valve 43 switched from the open state to the substantially closed state (step S411 in FIG. 5). As a result, the engine stall prevention control process is not executed in the time region where $t_1$ seconds have passed after the change of the signal XIDL from the OFF state to the ON state. Thus, even If the variation DLNE reaches or exceeds γ rpm due to noise entering the variation DLNE, the engine stall prevention control process is prevented from being executed (shown as phantom indicated by (2) in FIG. 6F). This prevents the revolutional speed NE of the engine 40 from unnecessarily increasing when the variation DLNE is mistakenly detected due to noise generated by disturbance (e.g., external radio wave).

Thus, in the idling speed controller according to the present invention, the adjustment of the air amount supplied to the engine 40 is prohibited after a predetermined time has passed since the throttle valve 43 switched from the open state to the substantially closed state. With this control, the air amount is not adjusted when the variation DLNE in the revolutional speed of the engine 40 reaches or exceeds a predetermined value due to noise after the passing of the predetermined time. This means that the control of increasing the intake amount in response to a decrease in the revolutional speed of the engine 40 is not executed when the idling state of the engine 40 continues for a predetermined period, i.e, when the car stops or runs in a creep state, for example. As a result, the revolutional speed of the engine 40 is prevented from unnecessarily increasing due to noise entering the ECU.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An idling speed controller for an internal-combustion engine, comprising:

means for judging whether the internal-combustion engine is in an idling state;

means for judging whether a variation in the revolutional speed of the internal-combustion engine is equal to or greater than a predetermined value;

air amount adjustment means for adjusting an air amount supplied to the internal-combustion engine when it is judged that the internal-combustion engine is in the idling state and the variation in the revolutional speed of the internal-combustion engine is equal to or greater than the predetermined value; and means for prohibiting the adjustment of the air amount by the air amount adjustment means after the passing of a predetermined time from a change of a throttle valve from an open state to a substantially closed state.

2. An idling speed controller according to claim 1, wherein the air amount adjustment means comprises an actuator for driving a throttle lever, and an opening of the throttle valve is adjusted in association with the throttle lever.

3. An idling speed controller according to claim 1, wherein the air amount adjustment means comprises an actuator for driving an idling speed control valve disposed in a bypass bypassing the throttle valve and connecting en upstream of the throttle valve with a downstream of the throttle valve.

4. An idling speed control method for an internal-combustion engine, comprising the steps of:

a) judging whether the internal-combustion engine is in an idling state;

b) judging whether a variation in the revolutional speed of the internal-combustion engine is equal to or greater than a predetermined value;

c) adjusting an air amount supplied to the internal-combustion engine when it is judged that the internal-combustion engine is in the idling state and the variation in the revolutional speed of the internal-combustion engine is equal to or greater than the predetermined value; and d) prohibiting the adjustment of the air amount in step c) after the passing of a predetermined time from a change of a throttle valve from an open state to a substantially closed state.

5. An idling speed control method according to claim 4, wherein step d) comprises the steps of:

detecting a change in a signal XIDL; and prohibiting the adjustment of the air amount in step c) after the passing of a predetermined time $t_1$ from the change in the signal XIDL, and the signal XIDL changes when a predetermined time T has passed from a change in a throttle full close signal WIDL and an opening of the throttle valve is smaller than a predetermined multiple of an opening of the throttle valve at the moment of the change of the throttle full close signal WIDL.

6. An idling speed control method according to claim 4, where the adjustment of the air amount in step c) is performed by an actuator, and the prohibition of the adjustment of the air amount in step d) is achieved by setting a control amount for driving the actuator at zero.

* * * * *